US011460264B2

(12) United States Patent
Wood

(10) Patent No.: US 11,460,264 B2
(45) Date of Patent: Oct. 4, 2022

(54) ANTI-CHOP SYSTEM FOR MECHANICAL PAINTBALL MARKERS

(71) Applicant: Planet Eclipse UK Limited, Manchester (GB)

(72) Inventor: Jack Kingsley Wood, Snelson (GB)

(73) Assignee: Planet Eclipse UK Limited, Trafford Park (GB)

( * ) Notice: Subject to any disclaimer, the term of this patent is extended or adjusted under 35 U.S.C. 154(b) by 28 days.

(21) Appl. No.: 16/945,188

(22) Filed: Jul. 31, 2020

(65) Prior Publication Data

US 2021/0041206 A1 Feb. 11, 2021

Related U.S. Application Data

(60) Provisional application No. 62/883,765, filed on Aug. 7, 2019.

(51) Int. Cl.

| | |
|---|---|
| ***F41B 11/00*** | (2013.01) |
| ***F41B 11/71*** | (2013.01) |
| ***F41B 11/723*** | (2013.01) |
| *F41B 11/89* | (2013.01) |

(52) U.S. Cl.
CPC ..... *F41B 11/71* (2013.01); *F41B 11/723* (2013.01); *F41B 11/89* (2013.01)

(58) Field of Classification Search
CPC ..... F41B 11/57; F41B 11/71; F41B 11/00; F41B 11/722; F41B 11/723; F41B 11/724; F41B 11/89; F41B 11/52
USPC ..... 124/70–73
See application file for complete search history.

(56) References Cited

U.S. PATENT DOCUMENTS

| | | | | |
|---|---|---|---|---|
| 5,890,479 | A | 4/1999 | Morin | |
| 6,532,949 | B1 | 3/2003 | McKendrick | |
| 6,966,313 | B1 * | 11/2005 | Yokota | F41B 11/57 124/32 |
| 7,121,271 | B1 * | 10/2006 | Arndt | F41B 11/50 124/71 |
| 7,765,998 | B2 * | 8/2010 | Kaakkola | F41B 11/71 124/71 |
| 2006/0102161 | A1 * | 5/2006 | Wood | F41B 11/52 124/41.1 |
| 2006/0124118 | A1 * | 6/2006 | Dobbins | F41B 11/62 124/77 |
| 2006/0162716 | A1 * | 7/2006 | Dobbins | F41B 11/70 124/77 |
| 2006/0278206 | A1 * | 12/2006 | Dobbins | F41B 11/721 124/74 |
| 2007/0215134 | A1 * | 9/2007 | DeHaan | F41B 11/721 124/77 |

(Continued)

*Primary Examiner* — Michael D David
(74) *Attorney, Agent, or Firm* — Barlow, Josephs & Holmes, Ltd.; David R. Josephs

(57) ABSTRACT

An anti-chop system for mechanical paintball markers includes an optical sensor in the breech that detects presence of a properly seated paintball in the breech for launch. When such a paintball is not detected, a control circuit communicates with an actuatable structure that physically communicates with a paintball marker component that moves as part of the firing and launch of a paintball. For example, such an actuatable structure is a lever arm that communicates with the bolt or trigger to prevent the firing operation of the paintball marker when a paintball is not ready for launch.

15 Claims, 2 Drawing Sheets

(56) References Cited

U.S. PATENT DOCUMENTS

| | | | | |
|---|---|---|---|---|
| 2008/0078370 | A1* | 4/2008 | Kaakkola | F41A 21/12<br>124/71 |
| 2008/0099005 | A1* | 5/2008 | Kaakkola | F41B 11/73<br>124/71 |
| 2009/0241929 | A1* | 10/2009 | Italia | F41B 11/57<br>124/51.1 |
| 2010/0258101 | A1* | 10/2010 | Campo | F41B 11/57<br>124/51.1 |
| 2014/0096757 | A1* | 4/2014 | Larmer | F41B 11/52<br>124/73 |

* cited by examiner

ANTI-CHOP SYSTEM FOR MECHANICAL PAINTBALL MARKERS

CROSS REFERENCE TO RELATED APPLICATION

This application is related to, and claims benefit from, U.S. Provisional Application No. 62/883,765, filed on Aug. 7, 2019, entitled "ANTI-CHOP SYSTEM FOR MECHANICAL PAINTBALL MARKERS," incorporated by reference in its entirety, herein.

BACKGROUND OF THE INVENTION

The present invention generally relates to projectile launchers, including paintball markers. More specifically, the present invention relates to systems, methods and configurations for preventing chop or breaking of paintball projectiles that are not properly seated in the breech of the projectile launchers and ready for launch in projectile launchers, and, more specifically, mechanical-type paintball markers.

It should be understood that the present invention relates to the general loading of a projectile into the breech of a projectile launcher. In the game of paintball there are generally two main classifications of paintball markers. One of them would be mechanical markers, and the other would be electronic markers. These two types of paintball markers are exceedingly well known in the paintball industry. The present invention can be used in connection with any type of projectile launcher but is particularly well-suited for use in a mechanical-type paintball marker environment for launching paintballs. While reference may be made specifically to mechanical-type paintball markers for launching paintballs, this is just one of many different types of devices that can employ the present invention. It should be understood that the scope of the present invention is intended to encompass all type of projectile launchers for launching any type of projectile.

By way of example for ease of illustration and discussion, the prior art and the present invention will discussed in detail in connection with a mechanical paintball marker and its breech system.

In the prior art, it is well known to feed paintballs individually from a hopper which is commonly gravity fed. A prior art paintball marker is generally known to include a main body with a grip, trigger and barrel. Within the main body is a breech with a bolt that actuates back and forth therein. The bolt is retracted to allow a paintball to enter the breech from a supply of paintballs in hopper, which may be gravity fed, for example, via a feed tube, in preparation for launching. Once the paintball is within the breech, the bolt can be moved forward, as in well known in the art, to prevent further projectiles to enter breech and to load the projectile into the barrel. Then, the projectile within the barrel can then be launched in the normal fashion from the barrel, such as by the delivery of a blast of compressed air behind the projectile.

However, during loading of the paintball into the breech, it may bounce back up either fully or partially into the feedtube or, in general, may not be properly seated in the breech and fully ready for launch. If launch occurs when the paintball is not ready for launch, the bolt can easily break the partially loaded paintball within the breech, which can jam the marker rendering it unusable until it is unjammed and cleaned. This is particularly troublesome when such jamming occurs during competitive gameplay.

The desire for faster cycle times and firing rates has required that the loading and launching sequence be sped up considerably. This has further made the need for each paintball to be properly loaded and prepared for launching even more of a concern.

In prior art electronic paintball markers, breech sensors are commonly employed to sense when the paintball is in the breech and ready to be launched. Such a sensor is electronically connected to the operating system and the pneumatics of the marker to fully control the timing of loading and launching. Thus, if a paintball is sensed within the breech because it has reached the proper launch position, then it is perceived by the operating system that the paintball is suitable for immediate launching. Then, the operating system will permit the launching of the paintball.

For example, it is well known in the art that many paintball markers make use of a paintball sensing system that only allows the paintball marker to fire once a paintball is in a position to be fired. In most of these electronic markers, the sensing system is based upon opto-electronics whereby a transmitter is mounted on one side of the breech of the marker and a receiver is mounted on the opposite side of the breech so that any object coming between the transmitter and receiver can be detected. This is known as a photo-interrupter and is well known to those skilled in the art. In typical use, when something is detected between the transmitter and receiver, the electronic control system assumes that it is a paintball that is being detected and allows the marker to be fired and the paintball to be launched.

The aforesaid problem of launch readiness of the paintball to avoid breakage and jamming of the marker is concern with any type of paintball marker, including mechanical paintball markers. Since electronic paintball markers have some form of electronics in them that can control the firing cycle of the marker, there is need for such an anti-chop system in mechanical markers that have no such electronics in them. Electronic markers typically have some form of electronic switch that is actuated by the trigger mechanism. This switch is connected to a circuit that will control some form of actuator that will fire the marker when it receives a signal from the circuit. There is generally no connection between the trigger and the firing mechanism. On the other hand, on a mechanical marker, the mechanical trigger controls the firing cycle of the marker. Mechanical actuation goes unchecked in prior art mechanical paintball markers.

As discussed above, most modern electronic markers utilize some form of sensor in the breech to detect whether a paintball is present in the breech or not. The electronic circuit uses this information to decide whether or not to allow the marker to fire. Ideally the electronics would only allow a signal to be sent to the actuator to fire the marker when there is a paintball present in the breech. It is undesirable for the marker to fire when a paintball is not fully seated in the breech. If the marker fires while the paintball is only partially loaded it is very possible for the bolt to chop the paintball in half in the breech and feed tube. A broken paintball in the feed tube and breech will make the marker inaccurate and possibly prevent the feeding of further paintballs into the marker. It is therefore a preferred design to only allow the marker to fire once a paintball is fully in the breech.

However, on a mechanical marker there is no way to tell if a paintball is fully seated in the breech and truly ready for launch. There are no sensors in the breech and there is no control over the firing cycle. The operator may simply pull the trigger at any time at which point the marker fires with the hopes that the paintball was properly seated in the breech and ready for launch. The marker will fire regardless of whether there is a paintball in the breech, not in the breech, or just half way into the breech. Therefore, is it well known in the paintball industry that most mechanical markers are more susceptible to paintballs being chopped in the breech and feed than electronic markers that have an anti-chop breech sensor.

There have been many attempts in the prior to address the foregoing chop problem associated with paintball markers, particularly mechanical paintball markers. For example, the shape of the breech can be configured to avoid excessive bounce when, by gravity, the paintball drops into the breech. However, despite attempts to reduce paintball movement in the breech region, the user can still pull the trigger and mechanically start the firing cycle at any time. As a result, chop and jamming of the paintball marker can still occur and is not effectively avoided.

In view of the foregoing, there is a need to avoid paintball chop and jamming of markers, particularly those of the mechanical type. There is a need for an anti-chop system for mechanical paintball markers.

SUMMARY OF THE INVENTION

The present invention preserves the advantages of prior art projectile launchers and projectile feed systems, devices and methods. In addition, it provides new advantages not found in currently available systems and methods and overcomes many disadvantages of such currently available systems, devices and methods.

The invention is generally directed to the novel and unique anti-chop system in mechanical paintball markers that enables faster launching cycle times while avoiding jamming of projectiles during such launching.

It is therefore an object of the present invention to provide an anti-chop system for mechanical paintball markers.

It is a further an object of the present invention to provide an anti-chop system that can provide an otherwise fully mechanical paintball marker with some electronics to facilitate mechanical control of the firing of the marker and launch of the paintball. There is yet a further need to provide a paintball marker that includes both mechanical and electronic features to help avoid unwanted chop of paintballs.

BRIEF DESCRIPTION OF THE DRAWING FIGURES

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1A:
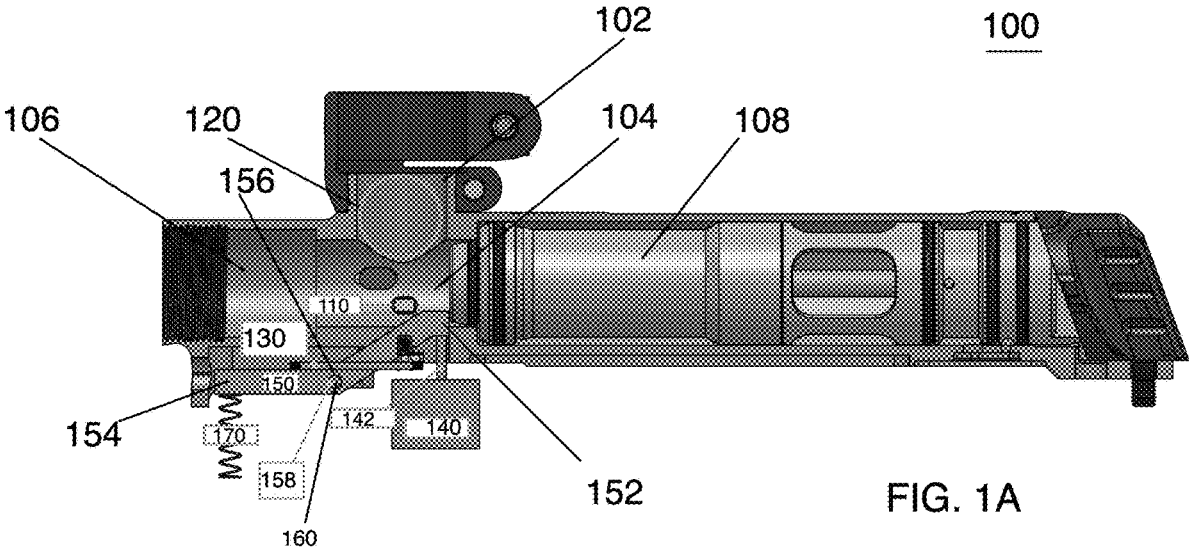
FIG. 1A is a side cross-sectional view of mechanical paintball marker employing a first embodiment of the anti-chop system of the present invention.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal. Further, for ease of discussion, the present invention is discussed in connection with paintball markers, but the invention is also related and applicable to other projectile launching devices, such as airsoft guns.

In general, an anti-chop system is disclosed to be incorporated into a mechanical type paintball marker, the structure of which is generally known in the prior art. Mechanical markers are known to be easier to repair as many parts are standard and easy to find. Additionally, the mechanical markers are known to be, relatively, less expensive than electronic markers. However, as noted above, on a mechanical marker there is no way to tell if a paintball is fully seated in the breech and truly ready for launch; there are no sensors in the breech and there is no control over the firing cycle; and the operator may simply pull the trigger at any time at which point the marker fires with the hopes that the paintball was properly seated in the breech and ready for launch. The mechanical marker will fire regardless of whether there is a paintball in the breech, not in the breech, or just half way into the breech. Therefore, the present disclosure seeks to remedy these deficiencies with mechanical markers by providing an anti-chop breech sensor and a mechanical stop to prevent the mechanical marker from being fired while maintaining the aforementioned benefits.

In an exemplary embodiment of such an improved mechanical marker, the modified mechanical paintball marker can include a sensor in the breech, such as an optical infrared sensor, to detect the presence or absence of a paintball. This is connected to a simple circuit that controls the position of a lever via an actuator. The lever can be used to control, or block, the movement of one of several potential mechanical elements within the marker to either prevent it from firing or allow it to fire. Thus, the present disclosure marries the benefits of the mechanical markers with the anti-chop sensors and mechanism of electronic markers.

For example, as in FIG. 1A, the anti-chop system of the present embodiment employs a sensor 110 to determine the presence or lack of a paintball 120 in a mechanical paintball marker 100. The term mechanical paintball marker is intended to be defined as a mechanically operated paintball marker that is operated using solely mechanical means, and as such does not use elements such as electro-pneumatic solenoids controlled by an electronic board and activated by a form of electronic switch actuated by the trigger to fire the paintball or projectile. A mechanical paintball marker uses only mechanical and/or pneumatic elements between the trigger mechanism and the firing system. While only a portion of a feed tube 102, breech 104, barrel 106, and bolt 108 are shown, one of ordinary skill in the art will understand that the present disclosure can be employed in any type of mechanical paintball marker. Generally, should the sensor 110 determine that the breech 104 of the marker 100 does not have a paintball 120 present or a fully seated paintball, a control signal can be sent to a control circuit 130. The control circuit 130 can be any known controller that includes a CPU, memory, and input/output ports. While the control circuit 130 is shown to be just below the breech 104, the control circuit 130 can be located anywhere on the marker 100 and can communicate wirelessly or wired with the sensor 110 and other components. In an exemplary embodiment, the sensor 110 is an optical sensor. However, the sensor 110 can be any known sensor for determining whether a paintball 120 is properly seated in the breech, including a weight sensor, laser, etc. Further, the control signal can be analogue or digital.

Figure 1B:
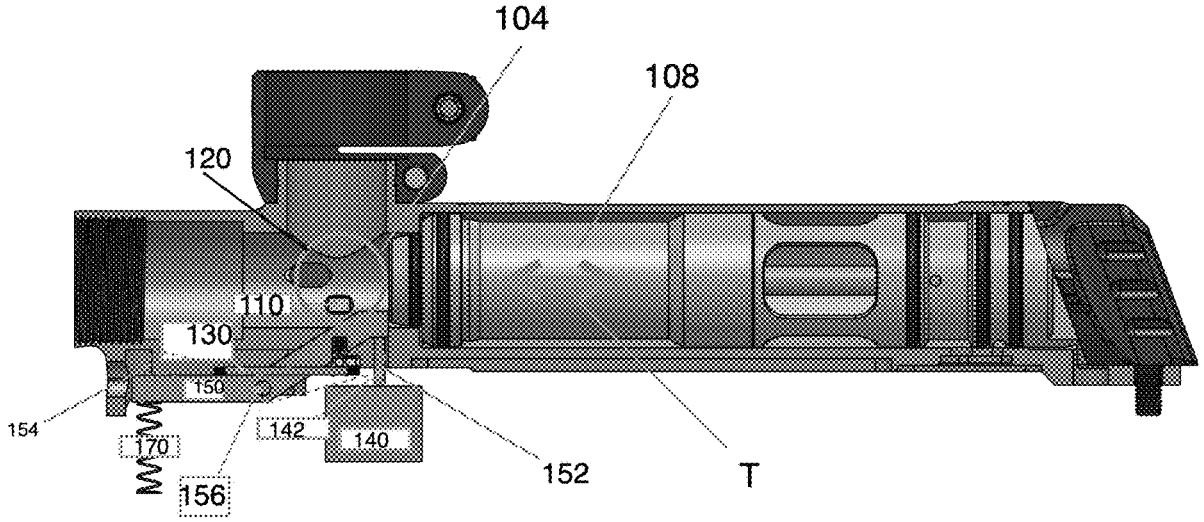
FIG. 1B is a side cross-sectional view of mechanical paintball marker employing the first embodiment of the anti-chop system of the present invention, showing the arm in a second configuration.

Based upon the control signal, the control circuit 130 can determine that the mechanical marker 100 should not be allowed to fire by use of a mechanical stop. For example, the mechanical stop can include a solenoid 140 that pivots a lever arm 150 to lock the lever arm 150 in a location that prevents the bolt 108 from traversing through the breech 104. The lever arm 150 can be generally "V" shaped having a first free end 152 and a second free end 154, with a pivot point 156 in the bend of the arm. The lever arm can have a through hole 158, through which a pivot pin 160 is received to allow the lever arm 150 to rotate about the pivot pin 160. The first free end 152 of the lever 150 can be disposed to be put in place of the bolt 108, as shown in FIG. 1A, or out of the path of the bolt 108, as shown in FIG. 1B. In the second configuration of FIG. 1B, the bolt 108 can be moved through the breech 104, as shown by the arrows T. The solenoid 140 can be controlled by the control circuit such that actuates a plunger arm 142 to an extended position, as in FIG. 1A, when the appropriate signal is generated by the sensor. When the lever 150 is in the locked configuration of FIG. 1A, a return spring 170 can be in a compressed configuration. In an alternative embodiment, the solenoid and plunger can be other linear actuators. In the illustrated embodiment, the solenoid plunger arm 142 can contact the first free end 152 of the lever to rotate the lever counter clockwise, relative to the perspective in the figure, to physically block the bolt 108 within the marker 100 when no paintball 120 is detected within the breech 104 or fully seated in the breech. The first free end 152 of the lever can be disposed in the breech in front of the bolt 108, and locked in place by the solenoid plunger 142, such that the bolt 108 cannot be displaced. Advantageously, the instant system can be employed to lock the bolt without the need for additional electronics in the trigger or mechanisms to prevent a premature firing of the marker.

Once a paintball 120 is sensed, by the sensor 110, to be properly seated for firing as seen in FIG. 1B, the solenoid 140 can be released and the spring 170 can spring-bias the second free end 154 of the lever arm out of the path of the bolt, as shown in phantom in FIG. 1B. In the unlocked configuration of FIG. 1B, the spring is extended or expanded, as shown in phantom, while the solenoid 142 plunger is retracted into the solenoid 140. The illustrated spring 170 is a helical spring, though other linear actuators can be used in place. In contrast, as discussed above, when no paintball 120 is sensed in the breech 104 the circuit control 130 can cause the solenoid 140 to extend the plunger 142 into the first free end 152 of the lever arm, against the forces of the spring 170, to cause the free end of the lever arm to block further leftward/forward travel of the bolt 108 thereby preventing firing unless a paintball 120 is properly seated in the breech and ready for launch, as seen in FIG. 1A.

Figure 2:
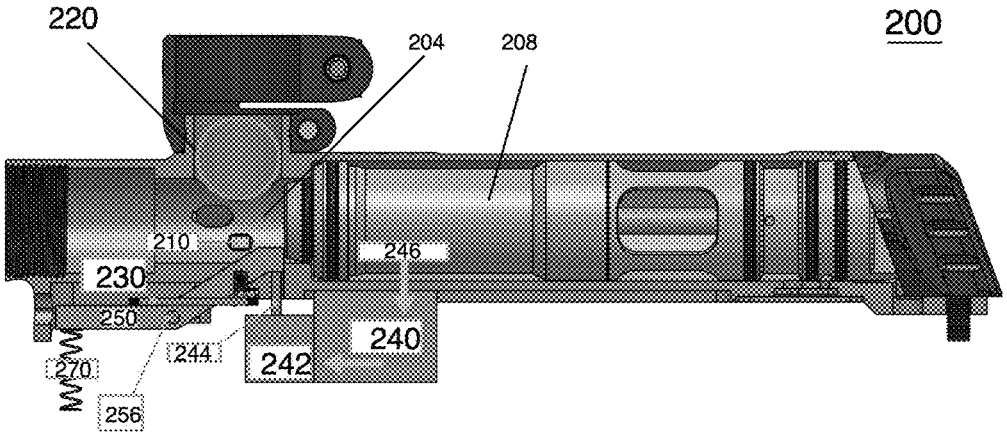
FIG. 2 is a side cross-sectional view of mechanical paintball marker employing a second embodiment of the anti-chop system of the present invention.

A second preferred embodiment is shown in FIG. 2, such an embodiment can employ a circuit 230 that can control an electro-pneumatic solenoid valve 240 that is used to drive a small piston 242 that prevents the movement of the bolt 208, or trigger, or any other part of the mechanical markers 200 firing and cycling system to prevent it firing when there is no paintball 220 detected within the breech. The sensor 210, control circuit 230, lever arm 250, and spring 270 arrangements are substantially the same as the embodiment of FIGS. 1A and 1B, and will not be further discussed for brevity. The electro-pneumatic solenoid valve 240 can advantageously make use of existing pneumatic systems 246 in the mechanical marker 200 to extend, or actuate, a piston 244 disposed in the piston housing 242. Thus, when a paintball 20 is not sensed as being properly seated in the breech 204 for launch, the solenoid valve 240 can be opened to allow air, or fluid, from the supply 246 to flow through the valve 240 towards the piston housing 242. The fluid can actuate the piston 244 in the piston housing 242 to push the free end of the lever 250 upward in the path of the bolt 208 to thereby block travel of the bolt 208 into communication with the paintball 220 in the breech 204.

A further alternative embodiment (not shown) is envisioned where the circuit controls a mechanism that prevents the actuation of the trigger when there is no paintball detected within the breech. In such an embodiment, the lever arm is configured and arranged proximal to the mechanical trigger itself whereby the lever arm physically blocks travel of the trigger to prevent firing of the trigger and the resultant paintball launch. As noted above, the instant embodiments can be used to lock other mechanical components of the marker including, but not limited to, the trigger, the bolt, the air valves, or other components can be locked with a piston or solenoid as disclosed herein.

The embodiments shown in the attached figures and discussed above are examples of how a mechanical paintball marker can be modified to employ an optical sensor to, in turn, mechanically prevent unwanted travel of the bolt into the breech and into communication with the paintball until a paintball is adequately seated in a launch position in the breech. The mechanical actuator can be a lever arm, as above, or any mechanical structure that blocks any component of the paintball marker that moves as part of the paintball firing/launch process.

In some alternative embodiments, the anti-chop assembly can be employed as a trigger lock to prevent the paintball marker from being used unless the control circuit receives the proper signal. For example, the marker can have a fingerprint sensor on the grip, or other parts thereof, to require authentication by the primary user to allow the marker to be fired. When a correct fingerprint is sensed, the instant control circuit can disengage the anti-chop system to allow the mechanical marker to be fired. Other sensor types can be used, such as BLUETOOTH Low Energy tags, retina scanners, other biometric sensors can be used to authenticate the user and "unlock" the marker.

It would be appreciated by those skilled in the art that various changes and modifications can be made to the illustrated embodiments without departing from the spirit of the present invention. All such modifications and changes are intended to be covered by the appended claims.

What is claimed is:

1. An anti-chop system for mechanical paintball markers, comprising:

a paintball marker having a breech and a movable component that is actuated as part of launching of a paintball; the movable component having a physical path of travel;

a sensor positioned in the breech that is configured and arranged for sensing presence of a paintball in the breech;

a control circuit connected to the sensor;

an actuatable member connected to and controlled by the control circuit; the actuatable member being selectively locatable in and out of the physical path of the movable component;

wherein actuation of the actuatable member locates the actuatable member in the physical path of the movable component thereby preventing movement of the movable component and preventing the firing operation of the paintball marker.

2. The anti-chop system of claim 1, wherein the movable component is a bolt.

3. The anti-chop system of claim 1, wherein the movable component is a trigger.

4. The anti-chop system of claim 1, wherein the actuatable member is a solenoid controlled plunger.

5. The anti-chop system of claim 1, wherein the actuatable member is a solenoid valve controlled piston.

6. The anti-chop system of claim 1, wherein the sensor is an optical sensor.

7. The anti-chop system of claim 6, wherein the optical sensor is configured and arranged for sensing whether the paintball is fully seated, partially seated, or not seated in the breech.

8. The anti-chop system of claim 7, wherein the optical sensor is configured and arranged to send a signal to the control circuit that indicates the paintball is fully seated, partially seated, or not seated in the breech, and wherein the control circuit is configured and arranged to remove the actuatable member from the physical path of the movable component to allow movement of the movable component and the firing operation of the paintball marker only when the paintball is fully seated in the breech.

9. A control system for mechanical paintball markers, comprising:

a mechanical paintball marker having a movable component that is actuated as part of launching of a paintball; the movable component having a physical path of travel;

a sensor configured and arranged to create a control signal;

a control circuit connected to the sensor to receive the control signal;

an actuatable member connected to and controlled by the control circuit; the actuatable member being selectively locatable in and out of the physical path of the movable component;

wherein the control circuit is further configured and arranged to actuate the actuatable member into the physical path of travel of the movable component to prevent movement of the movable component thereby preventing the firing operation of the paintball marker.

10. The control system of claim 9, wherein the movable component is a bolt.

11. The control system of claim 9, wherein the movable component is a trigger.

12. The control system of claim 9, wherein the actuatable member is a solenoid controlled plunger.

13. The control system of claim 9, wherein the actuatable member is a solenoid valve controlled piston.

14. The control system of claim 9, wherein the sensor is an optical sensor that is configured and arranged to send a signal to the control circuit that indicates the paintball is fully seated, partially seated, or not seated in a breech of the mechanical marker, and wherein the control circuit is configured and arranged to remove the actuatable member from the physical path of the movable component to allow movement of the movable component and the firing operation of the paintball marker only when the paintball is fully seated in the breech.

15. The control system of claim 9, wherein the control circuit is configured and arranged to remove the actuatable member from the physical path of the movable component to allow movement of the movable component and the firing operation of the paintball marker only when an unlock signal is received by the control circuit.

* * * * *